United States Patent [19]

Mundhenk et al.

[11] 4,416,333

[45] Nov. 22, 1983

[54] CORROSION INHIBITING PROCESS FOR A REMOTELY LOCATED DEEP CORROSIVE GAS WELL

[75] Inventors: David L. Mundhenk; Michael A. Curole, both of Metairie, La.

[73] Assignee: Shell Oil Company, Houston, Tex.

[21] Appl. No.: 370,017

[22] Filed: Apr. 20, 1982

[51] Int. Cl.[3] ..... E21B 43/40; E21B 47/06

[52] U.S. Cl. ..... 166/250; 166/244 C; 166/267; 166/310; 166/362; 166/371

[58] Field of Search ..... 166/244 C, 250, 265, 166/267, 310, 362, 371; 252/8.55 E

[56] References Cited

U.S. PATENT DOCUMENTS

| | | | |
|---|---|---|---|
| 2,466,530 | 4/1949 | Blair, Jr. et al. | 252/8.55 E |
| 2,839,465 | 6/1958 | Jones | 252/8.55 E |
| 2,884,067 | 4/1959 | Marken | 166/310 X |
| 2,966,458 | 12/1960 | Counts | 252/8.55 E |
| 3,455,394 | 7/1969 | Knight | 166/371 |
| 3,531,160 | 9/1970 | Fisher | 166/267 X |
| 3,744,565 | 7/1973 | Brown | 166/371 X |
| 4,033,410 | 7/1977 | Kauffman | 166/244 C |
| 4,285,401 | 8/1981 | Erickson | 166/371 X |
| 4,295,979 | 10/1981 | Sharp et al. | 166/244 C X |
| 4,354,553 | 10/1982 | Hensley | 166/267 X |

*Primary Examiner*—Stephen J. Novosad
*Assistant Examiner*—George A. Suchfield

[57] ABSTRACT

The process of providing corrosion protection in a deep, offshore, corrosive gas well containing acid gases such as $H_2S$ or $CO_2$ by continuously circulating a manufactured carrier oil containing a corrosion inhibitor can be improved where that well or a nearby well produces a condensate that contains high boiling, organic compounds. Determinations can be made and utilized concerning whether, and to what extent, portions of such a carrier oil can be replaced by portions of such a condensate.

4 Claims, 3 Drawing Figures

LIGHT CUT OIL
18
16
11
13
LOW PRESSURE GAS
14
15
STEAM
10
8
9
12
17
7
19
21
LOW PRESSURE GAS
6
4
20
HIGH PRESSURE GAS
3
2
5
22
1
PRODUCED FLUID
WATER
WATER
CARRIER OIL / CORROSION INHIBITOR
REINJECTED INHIBITOR SYSTEM

CORROSION INHIBITING PROCESS FOR A REMOTELY LOCATED DEEP CORROSIVE GAS WELL

BACKGROUND OF THE INVENTION

This invention relates to controlling corrosion in a well which produces a hot and highly pressurized corrosive gas, by continuously injecting an oil-phase liquid containing a corrosion inhibitor. The invention applies to such a well which is in a relatively remote location and produces, or is near a well which produces, a gas containing a condensate inclusive of significant amounts of high-boiling, oil-soluble polar organic liquid components. The invention is particularly applicable to such a well in an offshore location.

Considerable information has been published in journal articles and patents regarding the problems of controlling corrosion in deep corrosive gas wells. For example, the article entitled "Deep Wells-A Corrosion Engineering Challenge" by R. N. Tuttle and T. W. Hamby (presented in a meeting in Toronto in April, 1975, and published in the October 1977 Materials Performance) points out that such wells may have bottomhole temperatures as high as 550° F. and bottomhole pressures exceeding 22,000 psi. Also, in some such wells, the acid-gas content may represent more than half of the gas phase and the produced gas may be saturated with water and under saturated with respect to heavy hydrocarbons. In deep sour gas wells in the Thomasville-Piney Woods Field, such corrosion problems have been controlled by continuously circulating an oil containing a corrosion inhibitor within the well to maintain a corrosion-preventing oil-phase liquid film on the well conduits. A manufactured combination heavy oil/corrosion inhibitor mix was found to be effective at pressures of about 9,500 psi and 380° F. As indicated in the article, such systems and their use have been made commercially available by a data generation program that is available to industry and governmental agencies. SPE paper No. 8310, "Corrosion Control-Deep Sour Gas Protection" by Morris C. Place, Jr. (presented September 1979) describes additional details of the corrosion-inhibiting procedure and lists numerous characteristics which are essential for a successful system. A paper entitled "Development of High Pressure Sour Gas Technology" by Tyler W. Hamby, Jr., Petroleum Technology, May 1981, discusses the graph from which the present FIG. 1 is taken, reviews the major problem areas, and discusses the progress made and problems remaining after about ten years since the high pressure sour gas field was discovered.

U.S. Pat. No. 4,295,979 is directed to the same type of corrosion inhibiting problem. It quotes a statement from the 1975 Tuttle and Hamby article on the need for an inhibitor-carrier oil "which would provide a high dewpoint pressure at low concentration in the mixed gas-oil inhibitor phase" and says, "the present invention is such a system". The system described in the patent is a carrier oil which is manufactured by adding elemental sulphur to an amine activated dialkyldisulfide oil.

SUMMARY OF THE INVENTION

The present invention relates to improving the corrosion protection provided by continuously circulating a manufactured carrier oil within a well which produces a hot, highly pressurized, corrosive gas which yields a condensate which contains a significant amount of high-boiling, oil-soluble, polar organic liquid components (i.e., materials having relatively highly polar and/or aromatic properties), or is near a well which does produce such components. A determination is made of the phase characteristics, at the reservoir temperature and pressure, of mixtures of that condensate and the produced gas with a combination of a manufactured carrier oil and corrosion inhibitor which is capable of controlling the corrosion in the well to be treated. That well is then treated by a continuous circulation of a mixture of those components in proportions such that the mixture is (a) capable of maintaining a corrosion-inhibiting proportion of oil-phase liquid at the reservoir temperature and pressure, (b) contains less of the manufactured carrier oil than that needed to provide such a liquid phase when no condensate is present, but (c) contains enough of the manufactured carrier oil to maintain such a liquid phase during variations, to an extent which is likely, in the composition of the fluid produced from the well.

DESCRIPTION OF THE INVENTION

As known to those skilled in the art, meaningful predictions cannot be made as to whether a given high-boiling liquid is capable of serving as a carrier oil for a corrosion inhibitor in a well which produces a hot, highly pressurized corrosive gas. In addition, particularly in deep corrosive gas wells in a remote location such as an offshore location, it is extremely expensive to drill and/or re-work a well. Therefore, such a well cannot be safely or economically operated without a corrosion-inhibitng system that is effective throughout its full depth.

As indicated by the cited references, previously known successful corrosion inhibiting systems utilize a continuous injection of an effective combination of corrosion inhibitor and manufactured carrier oil. In a relatively highly productive offshore well, the amount required of such a manufactured carrier oil may be substantially prohibitive to transport and store—such as an amount in the order of 30,000 barrels per month.

Applicants have discovered that where the hot, corrosive gas produced by an oil contains condensable components inclusive of a significant amount of high boiling, oil-soluble, polar organic liquid, laboratory tests can be used to determine whether, and to what extent, some of the manufactured carrier oil can be replaced by some liquid condensed from the produced gas. This can make it economically feasible to protect a relatively remote well by using only enough of the manufactured carrier oil to be sure of maintaining protection during variations of the type to be expected in the fluid produced from such a well.

Figure 1:
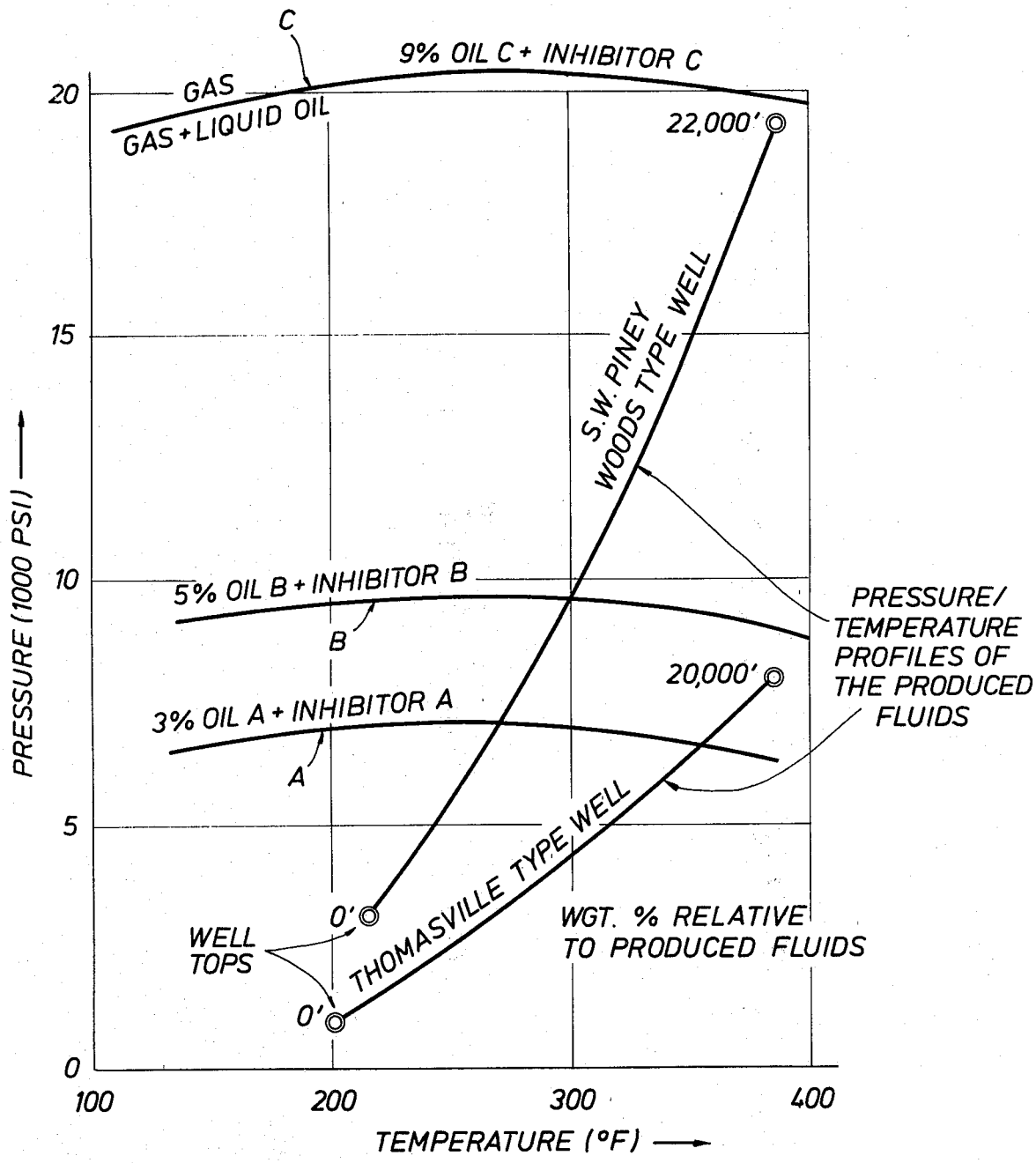
FIG.1 (PRIOR ART)
FIG. 1 shows the phase behavior of prior art corrosion inhibiting fluid systems in deep corrosive gas wells.

FIG. 1 shows the phase behavior, under downhole flowing conditions, of various manufactured carrier oil-inhibitor mixtures which have been used in wells. As indicated on the drawing, the two near-vertical curves represent the pressure/temperature profile of the produced fluids as they move from the bottoms of wells, at 20,000 and 22,000 feet toward the tops of the wells (at the bottoms of the curves). The horizontal curves, A, B and C, show the pressure-temperature conditions at which the respective inhibitor systems begin to condense (exhibit a dew-point) in contact with the gaseous fluids produced from those wells. Below the intersections with Curves A, B and C, the oils are presentm as a liquid phase, in the fluid flowing through the well, thus providing a protective film on the tubing. For example, the system relating to Curve A, which condenses at about 350° F. and 6000 psi, could not protect the lower part of the tubing string in even the Thomasville type well. The system provided by Curve B effectively controlled the Thomasville type well but would not be effective for the Southwest Piney Woods type wells which extend to 22,000 feet. The fact that since the oil/inhibitor system C was introduced into both fields (in early 1975) the corrosion which has been found (by caliper surveys and pulling of tubing) was minimal or nonexistent, is indicative of the adequacy of such phase relationship tests to indicate whether a given carrier oil system may be effective in a given well. And, it also indicates the field-worthy effectiveness of the proportions of the carrier oil systems which are injected into such wells in accordance with Shell Oil Company's commercially available corrosion protecting program.

Figure 2:
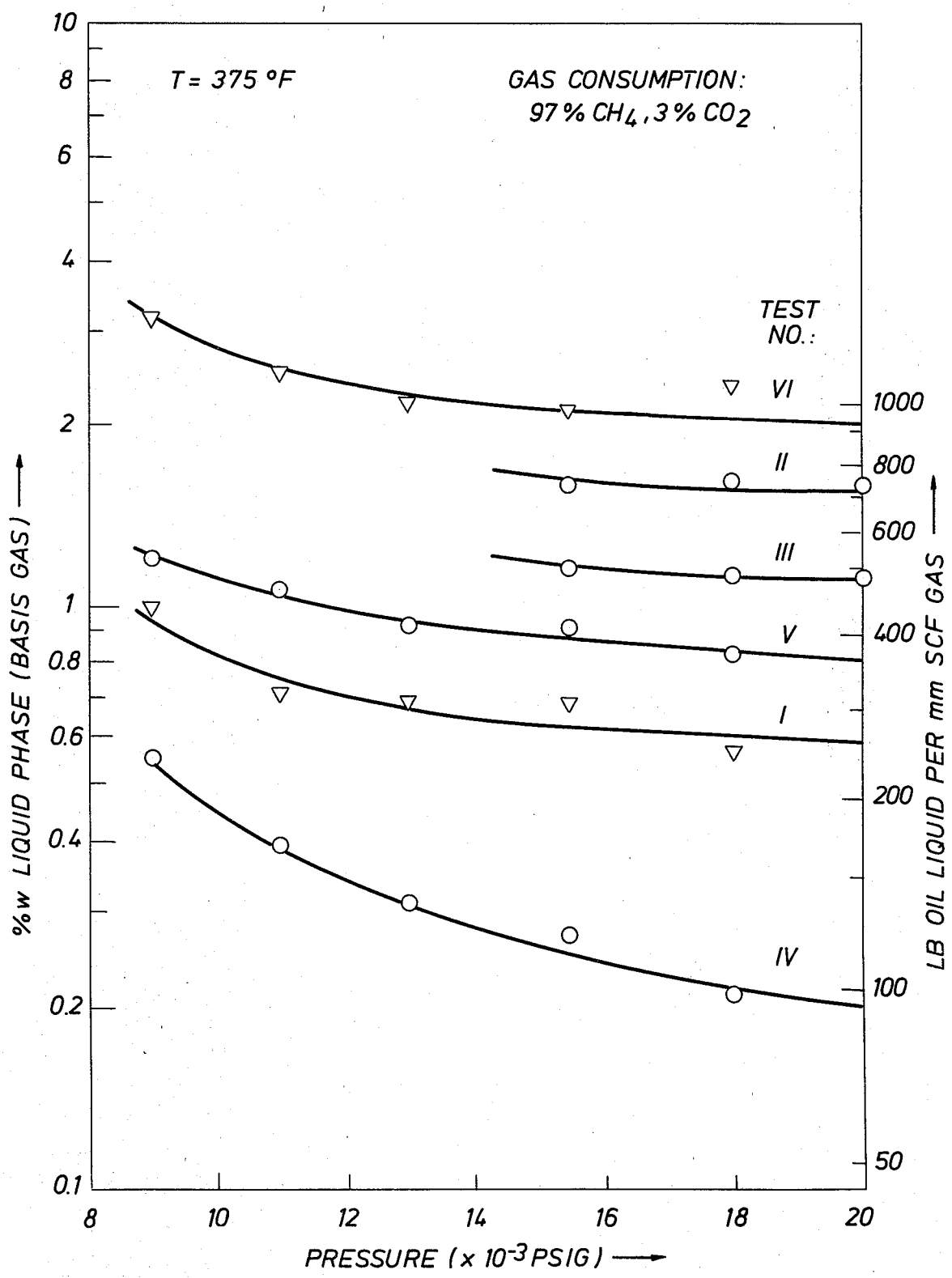
FIG. 2 shows the results of comparative tests of the phase behavior of fluids inclusive of those of the present invention in a corrosive gas at deep well conditions.

FIG. 2 shows the results of comparative tests of the phase behavior of fluids inclusive of those of the present invention in a hot, high pressure corrosive gas at a reservoir pressure and temperature at which such a gas is produced. A production condensate fluid was obtained from a gas well having a flowing fluid pressure (upstream of the choke) of about 10,000 psi. The reservoir is one in which the bottomhole conditions might include a pressure of 20,000 psi and a temperature of 375° F., and is expected to have a gas production capacity of from about 50 to 250 million standard cubic feet per day (mmscfd) per well. The gas from that reservoir is composed of about 97 mole percent methane and 3 mole percent carbon dioxide, and includes a condensate in an amount estimated to be between about 0.5 and 2.0 barrels condensate per mmscf gas.

Table 1 lists compositions of the various mixtures used for the measurements and Table 2 presents the experimental data, i.e., amount of oil dissolved in the vapor phase as a function of pressure and initial oil concentration in the gas.

TABLE 1

Test Mixture Compositions

| Experiment | Condensate Concentration in Gas (bbl/mmscf) | Condensate Concentration in Gas Wt % | Water Concentration in Gas |
|---|---|---|---|
| I | 0 | 0 | saturated (~3.0 mole percent water) |
| II | 20 | 11.7 | |
| III | 5 | 3.1 | |
| IV | 0 | 0 | |
| V | 5 | 3.1 | |
| VI | 20 | 11.7 | saturated (~3 mole percent water) |
| VII | 20 | 11.7 | |

Tests I-VI contain 1.9 weight percent (basis gas) carrier oil.

TABLE 2

Phase Data for Inhibitor Carrier Oil in Natural gas

T = 375° F.
Gas Composition: 97 mole percent methane, 3 mole percent carbon dioxide
Carrier Oil: Commercially available mixture of heavy oil and diesel oil ("C-oil")
Condensate: Production condensate from a corrosive gas well ("Condensate")
Concentration of heavy oil in gas: 1.5 percent by weight

| Experiment | Pressure psia | Carrier Oil/ Condensate (wt %) | Vapor Concentration of Oil Components g/l* | Liquid Phase g/l* | Percent Weight Oil Rich Phase (Basis Gas) | Mole Fraction Water in Vapor Phase |
|---|---|---|---|---|---|---|
| I | 20,000 | 1.9 | 0.0085 ± 0.0010 | 0.0051 | 0.71 | 0.0277 |
| | 18,000 | | 0.0096 ± 0.0005 | 0.0040 | 0.56 | 0.0295 |
| | 15,500 | | 0.0088 ± 0.0005 | 0.0048 | 0.67 | 0.0272 |
| | 13,000 | | 0.0087 ± 0.0001 | 0.0049 | 0.68 | 0.0298 |
| | 11,000 | | 0.0086 ± 0.0003 | 0.0050 | 0.70 | 0.0325 |
| | 9,000 | | 0.0075 ± 0.0001 | 0.0061 | 0.98 | 0.0361 |
| II | 20,000 | 13.6 | 0.0974 ± 0.0010 | 0.0114 | 1.60 | |
| | 18,000 | | 0.0968 ± 0.0006 | 0.0120 | 1.65 | |
| | 15,500 | | 0.0970 ± 0.0005 | 0.0118 | 1.62 | |
| III | 20,000 | 5.0 | 0.0299 ± 0.0001 | 0.0075 | 1.04 | |
| | 18,000 | | 0.0299 ± 0.0001 | 0.0075 | 1.04 | |
| | 15,500 | | 0.0300 ± 0.0002 | 0.0074 | 1.03 | |
| IV | 20,000 | 1.9 | 0.0120 ± 0.0003 | 0.0016 | 0.22 | |
| | 18,000 | | 0.0121 ± 0.0001 | 0.0015 | 0.21 | |
| | 15,500 | | 0.0117 ± 0.0006 | 0.0019 | 0.27 | |
| | 13,000 | | 0.0114 ± 0.0002 | 0.0022 | 0.31 | |
| | 11,000 | | 0.0108 ± 0.0002 | 0.0028 | 0.39 | |
| | 9,000 | | 0.0097 ± 0.0001 | 0.0039 | 0.54 | |
| V | 20,000 | 5.0 | 0.0313 ± 0.0010 | 0.0061 | 0.85 | |
| | 18,000 | | 0.0315 ± 0.0001 | 0.0059 | 0.82 | |
| | 15,500 | | 0.0308 ± 0.0004 | 0.0066 | 0.92 | |
| | 13,000 | | 0.0309 ± 0.0005 | 0.0065 | 0.90 | |
| | 11,000 | | 0.0299 ± 0.0004 | 0.0075 | 1.04 | |
| | 9,000 | | 0.0287 ± 0.0001 | 0.0087 | 1.20 | |
| VI | 20,000 | 13.6 | 0.0942 ± 0.0004[a] | 0.0146 | 2.00 | |
| | 18,000 | | 0.0932 ± 0.0010 | 0.0165 | 2.26 | |
| | 15,500 | | 0.0935 ± 0.0001 | 0.0153 | 2.10 | |
| | 13,000 | | 0.0917 ± 0.0009 | 0.0156 | 2.14 | |
| | 11,000 | | 0.0906 ± 0.0007 | 0.0182 | 2.49 | |
| | 9,000 | | 0.0858 ± 0.0006 | 0.0230 | 3.12 | |
| VII | 20,000 | 11.7 | 0.0836 ± 0.0005 | 0.0114 | 1.57 | |
| | 15,500 | | 0.0834 ± 0.0003 | 0.0116 | 1.60 | |
| | 13,000 | | 0.0845 ± 0.0001 | 0.0105 | 1.45 | |

TABLE 2-continued

Phase Data for Inhibitor Carrier Oil in Natural gas

T = 375° F.
Gas Composition: 97 mole percent methane, 3 mole percent carbon dioxide
Carrier Oil: Commercially available mixture of heavy oil and diesel oil ("C-oil")
Condensate: Production condensate from a corrosive gas well ("Condensate")
Concentration of heavy oil in gas: 1.5 percent by weight

| Experiment | Pressure psia | Carrier Oil/ Condensate (wt %) | Vapor Concentration of Oil Components g/l* | Liquid Phase g/l* | Percent Weight Oil Rich Phase (Basis Gas) | Mole Fraction Water in Vapor Phase |
|---|---|---|---|---|---|---|
| | 11,000 | | 0.0835 ± 0.0004 | 0.0115 | 1.58 | |

*Grams oil per standard liter of gas.
[a]Estimated using water saturation levels from Test I.
Density of gas at standard conditions = 0.7141 g/l.

The amounts of oil in an oil-rich phase were calculated at each pressure from the data in Table 2 by a mass balance based on the initial oil to gas ratio and are plotted in FIG. 2. It has been assumed that there is a single oil-rich phase. Whether there are multiple oil-rich phases cannot be determined from the present data. Smoothed curves have been drawn through the data points.

The gas mixture was saturated with water for Tests I and VI. There may be larger than usual uncertainties associated with results from Tests I and VI due to the experimental complications caused by the presence of water. The amount of water dissolved in the high pressure vapor phase was measured in Test I by the weight lost upon heating the condensate trapped from a vapor phase sample displaced from the high pressure cell. The water saturation levels agreed reasonably well with those found earlier in a similar well. However, the vapor phase condensate in these experiments contains light ends from condensate which may be lost with water upon heating. If these light ends are lost with the water, then the amount of water dissolved in the high pressure vapor phase will be overestimated. This causes an overestimation of the amount of equilibrium oil-rich phase for Test I. For Test VI, the amount of water in the vapor was assumed to be the same as in Test I. However, an increase in amount of oil present, as for Test VI as compared with Test I, tends to cause an increase in the water saturation level. Thus, the assumed water saturation levels for Test VI may have been underestimated causing an underestimation of the amount of equilibrium oil-rich phase.

The presence of water causes an increase in the amount of oil-rich phase. At 18,000 psi and 375° F., 1.9 weight percent oil present in the gas forms ~95 lb oil-rich phase per mmscf gas with no water present (Experiment IV) but forms ~250 lb oil-rich phase per mmscf gas when the gas phase is water-saturated (Experiment I). And for 1.9 weight percent oil plus 20 bbl condensate per mmscf gas, ~730 lb oil-rich phase per mmscf gas forms with no water (Experiment VII) and ~933 lb oil-rich phase per mmscf gas forms under water-saturated conditions (Experiment VI).

The presence of condensate in the mixture causes an increase in the amount of oil-rich phase present under given conditions. Condensate at a concentration of 20 bbl per mmscf gas forms an oil-rich phase up to 20,000 psi (Test VII). The amount of condensate in an oil-rich phase at 18,000 psi is equivalent to 11 percent of the total amount of condensate in the system.

Figure 3:
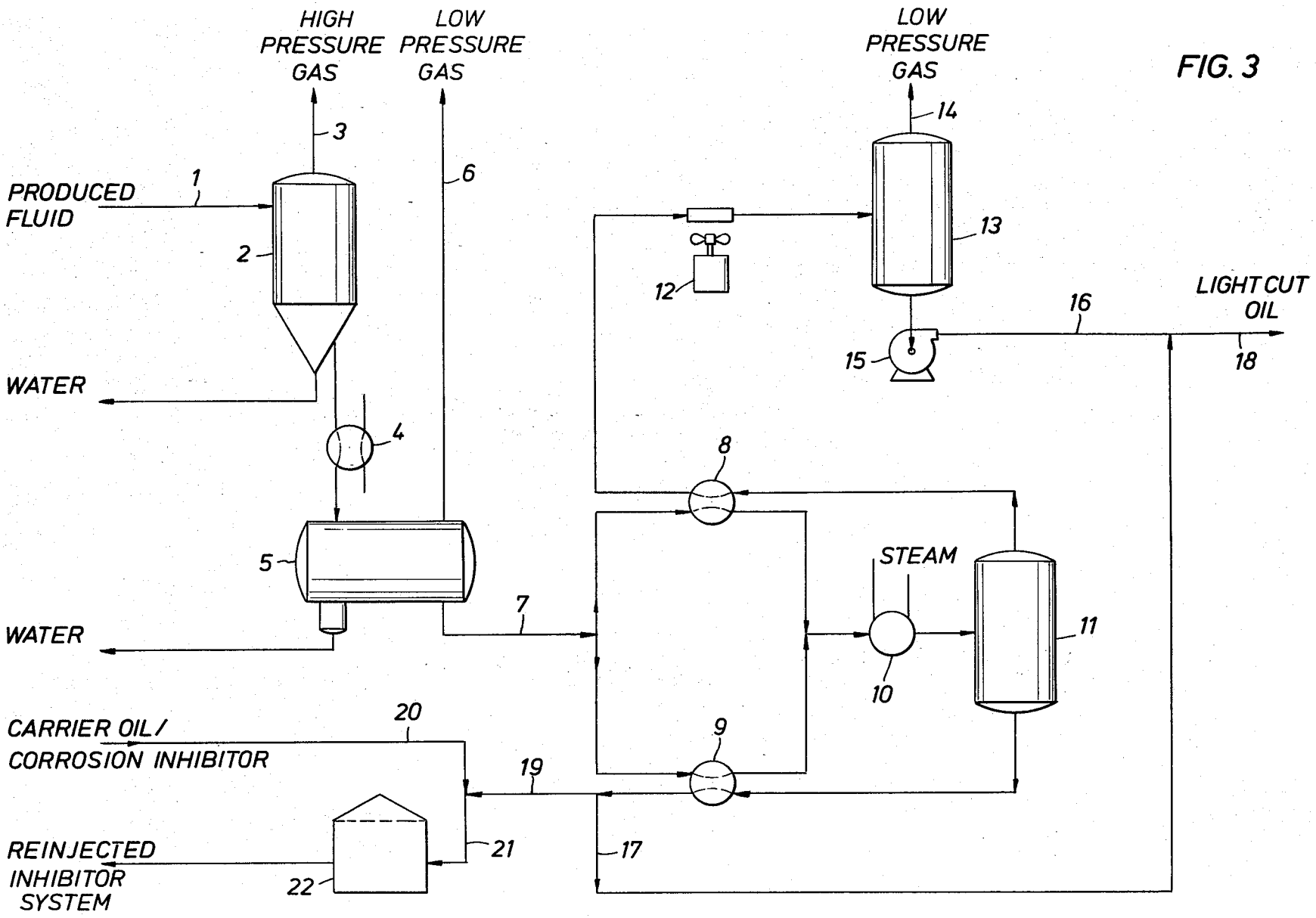
FIG. 3 schematically diagrams a process for recovering and recycling a corrosion inhibitor-containing condensate from a deep corrosive gas well, in accordance with the present invention.

FIG. 3 shows a process for recovering and recycling an inhibitor-containing condensate from the gaseous produced fluid from a well being treated in accordance with the present invention. The figure shows a produced fluid being flowed through conduit 1 into a three-phase separator 2. In the illustration, the produced fluid is assumed to consist of gas containing 97 mole percent methane and 3 mole percent $CO_2$ mixed with condensate and recycled corrosion inhibitor carrier oil.

Separator 2 is operated downstream of a choke at about 1215 psi and 100° F. to outflow a high pressure gas through conduit 3. The separated oil-phase liquid is heated in heat exchanger 4 and further separated in a bulk treater 5, at about 75 psia and 120° F., to outflow a low pressure gas through conduit 6. The oil-phase liquid from treater 5 outflows through conduit 7 and is split, e.g., into 10% and 90% fractions, which are each heated to 360° F., with the small fraction receiving heat from a hot vapor in exchanger 8 and the larger fraction receiving heat from a heavy oil cut in exchanger 9. The so-heated streams are recombined and further heated in trim heater 10 (with steam) to about 380° F. The 380° F. liquid is flashed in vapor-liquid separator 11 at about 25 psia. The hot vapor from separator 11 is first cooled to about 150° F. in heat exchanger 8 and then cooled to about 115° F. by means of hot vapor trim cooler 12. The vapor is separated from the 115° F. vapor in light cut oil recovery vessel 13, with a low pressure gas stream being outflowed through conduit 14 and a liquid-phase being fed to the intake of pump 15. Pump 15 displaces the liquid-phase, at about 25 lbs per square inch, into conduit 16 as a light cut oil. The heavy oil cut oil outflowing from vapor-liquid separator 11 at 380° F. is cooled to 150° F. in heat exchanger 9 and split into fractions. One fraction flows through conduit 17 to a junction with conduit 16 to provide an output composite oil flowing through conduit 18. The remainder of the cooled heavy cut oil leaving heat exchanger 9 flows through conduit 19 to a junction with conduit 20. Makeup portions of corrosion inhibitor-containing manufactured carried-oil flows through conduit 20 and is mixed with the heavy oil outflowing from heat exchanger 9. The combined streams are conveyed through conduit 21, through a filtering and monitoring facility 22, and on into the well, as a reinjected corrosion inhibitor system containing high-boiling components from the produced fluid condensate.

In conducting the present process, the determination of phase characteristics at reservoir pressure and temperature of mixture of a condensate and produced gas with a manufactured carrier oil and a corrosion inhibitor can utilize commercially available laboratory apparatus and techniques. For example, a preferred apparatus comprises a high pressure blind equilibrium cell. A selected mixture of the components is charged to the cell at the reservoir pressure and temperature and the cell is rocked for a significant time (such as about 14 hours) to ensure equilibrium. The amount of the carrier oil system which becomes dissolved in the vapor-phase of the corrosive gas can be determined by displacing the vapor out of the cell (without altering the pressure), condensing the oil in a cold trap, and measuring the gas volume. The amount of the carrier oil system which remained in the liquid phase can then be determined by mass balance.

The manufactured carrier oil to be used in such determinations should be one which is capable of maintaining a corrosion inhibitor-containing oil-phase liquid in contact with the gas produced from the well to be treated at the pressure and temperature of the reservoir from which the gas is produced, with that carrier oil being mixed with the produced gas at a relatively low ratio of oil-to-gas (such that an adequate rate of production can be obtained). Such a manufactured carrier oil can advantageously be a commercially available one which has been demonstrated by laboratory and field tests to be capable of controlling the corrosion in a well that produces a corrosive gas that is the same as or substantially equivalent to that produced from the well to be treated.

Preferably, the corrosion inhibitor to be used in the present process is one which has been similarly demonstrated to be effective in a well like the well to be treated. The main objective of the tests used in the present process is to determine how large a proportion of the manufactured carrier oil (if any) can be replaced by condensate available at or near the site of a remotely located well to be treated—without introducing a risk of a corrosion-induced failure of a well conduit.

The wells to which the present invention is applicable are substantially any which produce a hot highly pressurized corrosive gas which is substantially completely gaseous at the pressure and temperature of the reservoir but contains a significant proportion of high boiling, oil-soluble, polar organic compounds which condense as a separate liquid phase when the pressure and temperature of the produced gas are reduced to at or near atmospheric conditions. The extent to which the use of the present process is valuable increases with increases in the distance (and/or transporting or storing problems) of supplying a manufactured carrier oil from its source to the site of the well to be treated. A well which produces a hot, highly pressurized, corrosive gas that contains little or no condensate suitable for use in the present process but is located conveniently with respect to the delivery of such a condensate from a nearby well, can be treated, in accordance with the present process, with the condensate from that conveniently located well.

The present process of employing at least some produced gas condensate in the corrosion inhibiting system injected into the well tends to concentrate the highest boiling, and least hydrocarbon-like components of both the condensate and the manufactured carrier oil within the inhibitor-containing system. In such a procedure a significant portion of both the carrier oil and condensate components are recycled through the well and condensate recovery system. The accumulation of high boiling condensate components tends to reduce the proportion of manufactured carrier oil that may be required. However, that proportion should be kept high enough to ensure the corrosion protection will be maintained in spite of any variations in the composition of the produced gas that are to be expected in the type of reservoir from which the gas is being produced. Such wells can be sour gas wells such as the Thomasville and Piney Woods type wells described in the cited references, or wells productive of carbon dioxide-containing corrosive gases which are substantially free of sulphur or hydrogen sulfide, such as produced gases consisting essentially of gaseous hydrocarbons and carbon dioxide, or such gases mixed with water, etc.

What is claimed is:

1. A process for controlling corrosion in a well which produces a hot, highly pressurized, corrosive gas, by continuously injecting an oil-phase liquid containing an oil-soluble corrosion inhibitor, comprising:

treating such a well which (a) is located remotely with respect to the source of a manufactured carrier oil that is capable of maintaining an oil-phase liquid at the bottomhole conditions within the well to be treated and (b) produces, or is near a well which produces, a gas which contains a significant proportion of high-boiling, oil-soluble, organic compounds which condense as a liquid phase when the produced gas is cooled and depressurized;

determining phase characteristics, at the bottomhole temperature and pressure in the well to be treated, of mixtures of the gas produced by the well to be treated, a condensate comprising the high boiling components of gas produced from that well or a nearby well, a corrosion inhibitor which is effective at the bottomhole temperature within the well to be treated and a manufactured carrier oil capable of containing that corrosion inhibitor in a separate liquid-phase in contact with the gas produced by the well to be treated at the reservoir pressure and temperature of the well to be treated; and continually circulating into the well to be treated a mixture of the so-tested components in proportions such that the mixture is capable of maintaining a corrosion inhibitor-containing liquid-phase at the bottomhole pressure and temperature of the well to be treated when the amount of the manufactured carrier oil is less than that needed to maintain such a liquid phase when none of the condensate is present but enough of the manufactured carrier oil is present to maintain such a liquid-phase during fluctuations of the extent likely to occur in the composition of the condensate or reservoir temperature or pressure in the well to be treated.

2. The process of claim 1 in which the well to be treated is an offshore well.

3. The process of claim 1 in which the condensate high-boiling, oil-soluble, organic liquid compounds are separated from the produced gas by treating those fluids in an oil dehydration vessel, heating the oil dehydration vessel liquid and then flashing that liquid at a relatively low pressure.

4. The process of claim 1 in which the condensate which is tested and circulated into the well to be treated is obtained from fluid produced from a nearby well.

* * * * *